US007093457B2

(12) United States Patent
Foresman

(10) Patent No.: US 7,093,457 B2
(45) Date of Patent: Aug. 22, 2006

(54) ANNULAR COOLER PALLET CONSTRUCTION

(75) Inventor: James D. Foresman, Hughesville, PA (US)

(73) Assignee: Metso Minerals Industries, Inc., Milwaukee, WI (US)

( * ) Notice: Subject to any disclaimer, the term of this patent is extended or adjusted under 35 U.S.C. 154(b) by 0 days.

(21) Appl. No.: 10/764,203

(22) Filed: Jan. 23, 2004

(65) Prior Publication Data

US 2005/0160758 A1 Jul. 28, 2005

(51) Int. Cl.
*F25D 25/00* (2006.01)

(52) U.S. Cl. ..... 62/378; 62/381; 62/382

(58) Field of Classification Search ..... 62/378, 62/380, 381, 382, 63; 108/51.11, 57.17, 108/57.32; 248/346.02
See application file for complete search history.

(56) References Cited

U.S. PATENT DOCUMENTS

| | | | | | |
|---|---|---|---|---|---|
| 407,178 | A | * | 7/1889 | Evans | 108/51.11 |
| 458,000 | A | * | 8/1891 | Medoff et al. | 108/51.1 |
| 485,659 | A | * | 11/1892 | Medoff et al. | 108/51.1 |
| 3,302,936 | A | | 2/1967 | Ban | |
| 3,598,439 | A | * | 8/1971 | Dahlquist et al. | 294/65 |
| 3,627,079 | A | * | 12/1971 | Nielsen et al. | 187/406 |
| 3,844,422 | A | * | 10/1974 | Smith et al. | 414/789.9 |
| 3,942,658 | A | | 3/1976 | Bonnaure | 214/18 |
| 4,013,517 | A | | 3/1977 | Ban et al. | 202/262 |
| 4,091,750 | A | | 5/1978 | Thiesler et al. | 110/329 |
| 4,408,987 | A | | 10/1983 | Oyler | 432/137 |
| 4,489,659 | A | * | 12/1984 | Kamohara et al. | 104/124 |
| 4,570,782 | A | * | 2/1986 | Cargill et al. | 198/345.3 |
| 4,572,484 | A | * | 2/1986 | Coulter | 266/179 |
| 4,575,055 | A | | 3/1986 | Coulter | 266/159 |
| 4,600,380 | A | | 7/1986 | von Wedel | 432/58 |
| 4,649,588 | A | * | 3/1987 | Taylor | 14/3 |
| 4,665,830 | A | * | 5/1987 | Anderson et al. | 104/124 |
| 4,715,294 | A | * | 12/1987 | Depew | 108/57.17 |
| 4,870,913 | A | | 10/1989 | Schneider | 110/299 |
| 5,065,467 | A | * | 11/1991 | Forsyth | 14/13 |
| 5,103,523 | A | * | 4/1992 | Drago et al. | 14/2.4 |
| 5,322,434 | A | | 6/1994 | Milewski et al. | 432/78 |
| 5,412,863 | A | * | 5/1995 | Prodel | 29/799 |
| 5,788,480 | A | | 8/1998 | Bentsen et al. | 432/78 |
| 5,947,719 | A | | 9/1999 | Heinemann et al. | 432/78 |
| 5,992,334 | A | | 11/1999 | von Wedel | 110/300 |
| 6,012,387 | A | * | 1/2000 | Hoffman et al. | 101/115 |
| 6,135,531 | A | * | 10/2000 | Allen et al. | 296/39.1 |
| 6,266,883 | B1 | | 7/2001 | Heinemann et al. | 29/896.6 |
| 6,305,184 | B1 | * | 10/2001 | Kuhl | 62/380 |
| 6,840,181 | B1 | * | 1/2005 | Smyers | 108/56.1 |

FOREIGN PATENT DOCUMENTS

| | | | | |
|---|---|---|---|---|
| DE | 19621538 | A1 | * | 10/1996 |
| JP | 53119703 | A | * | 10/1978 |
| JP | 40615620 | A | * | 6/1994 |
| JP | 10-95432 | A | * | 10/1998 |

* cited by examiner

*Primary Examiner*—Mohammad M. Ali
(74) *Attorney, Agent, or Firm*—Andrus, Sceales, Starke & Sawall, LLP

(57) ABSTRACT

A pallet construction for an annular cooler forms a gas permeable surface for supporting and transporting material during processing thereof. The pallet construction includes a pallet deck having a series of substantially parallel rows of spaced apart elongated slots. Each of the rows of slots are staggered with respect to the slots in an adjacent row in the series. The slots define apertures through the pallet construction. The pallet construction also includes a support frame supporting the pallet deck and having at least one angular brace oriented at an acute angle with respect to the series of rows of slots.

19 Claims, 9 Drawing Sheets

ANNULAR COOLER PALLET CONSTRUCTION

FIELD OF THE INVENTION

The present invention relates to a pallet for use with a conveyor system, and more particularly relates to a pallet construction for use in an annular cooler having a circular traveling conveyor.

BACKGROUND OF THE INVENTION

Pallets are utilized in a wide variety of industrial processes for supporting and transporting materials from one place to another. Often the materials on the pallet also require processing such as heating or cooling. For example, in the production of iron pellets used as raw material to produce steel, balls of iron ore mixed with various elements are heated to a high temperature in a system that includes a traveling grate, rotary kiln, and an annular cooler. The pellets enter the system as soft, moist green balls and exit the system as hard, fully oxidized pellets that will not degrade during shipping and handling and that have an ideal size and shape for use in the steel making process. The hard pellets discharge from the rotary kiln at a temperature of approximately 2300° Fahrenheit and have to be cooled to a temperature of approximately 300° Fahrenheit. The hot pellets discharge from the rotary kiln and fall onto slotted pallets as they pass into the inlet area of the annular cooler, and are conveyed in a circle until cooled to a desired temperature. In the annular cooler, ambient air is forced up through the pellet bed supported by the pallets to cool the hot pellets. The rotating conveyor rotates at a speed generally between 1–2 revolutions per hour. The pallets travel in a circle around the annular cooler and each pallet typically comprises about a 10° segment of the circle. After having traveled nearly a complete circle around the cooler, the cooled pellets are discharged from the annular cooler in a dump zone.

The primary purposes of the pallet construction is to support the loading applied to the pallet deck and to maximize the amount of air flow through the pallet to cool the pellets. Under normal operating conditions, the loads applied to the pallet include the weight of the pellet bed and the impact loading of the pellets as they fall from the kiln discharge onto the pallet. An individual pellet is typically ⅜" in diameter so the impact loading of an individual pellet is quite small. Under normal operation conditions where the discharge of the pellets from the kiln is free flowing, the pallet does not see a significant impact loading condition. The total number of pellets on a pallet at a bed depth of 33 inches weighs approximately 14 tons. Therefore, the pallet must have sufficient structural integrity to support this loading.

However, under upset conditions, large chunks of agglomerated pellets can form in the kiln. This condition will result in a large impact loading on the pallet deck as thousands of pellets agglomerated together fall from the kiln as one large mass. If such large chunks are not prevented from falling onto the pallet deck by grizzly bars or other means, then the pallet construction must support large impact loading.

As capacities of pelleting systems have increased, the cooling requirement of the annular coolers have also become greater. The capacity of existing systems has increased to the point that the annular coolers are often the bottleneck in the system, prohibiting further increase in system pelleting capacity. One of the limiting factors in increasing the cooling capacity of existing annular coolers is the available slot area in the existing pallet constructions available for cooling air to pass through. Therefore, further increase in slot open area is desired to increase system cooling efficiency and increase the capacity and throughput of the annular cooler. This increase in slot open area must, however, be achieved while retaining the operational and dimensional features of the existing pallet design. For example, the depth of the pallet support frame cannot be greater than the existing pallet design because the improved pallet must fit into and operate within existing cooler installations.

In a typical annular cooler, the various cooling zones are partitioned off into various sections for heat recovery purposes and there is a limited clearance into which the pallet constructions must pass. The small clearance allows for sealing between the different zones and further increases the efficiency of the annular cooler. Therefore, any improved pallet structure must be designed so that there is a section of the pallet construction that passes through the small clearance in such a way that an air seal is formed between the pallet and the cooler.

It is therefore desirable to provide an improved pallet construction which increases the amount of open area to increase the volume of cooling air that passes through the pallet. It is further desirable to provide such a pallet construction which maintains or increases the amount of load capacity provided by known pallet constructions. It is further desirable to provide such a pallet construction which has the same or greater structural strength as existing designs and which properly supports small-sized material, such as the above-mentioned iron pellets. It is further desirable to provide such a pallet construction which retains certain existing configurations of support members, such as depth thereof, such that the improved pallet fits into and operates properly with existing cooler installations.

SUMMARY OF THE INVENTION

The present invention relates to such an improved pallet construction for an annular cooler which increases the amount of open area to increase the volume of cooling air that passes through the pallet so that the pallet provides greater cooling capacity than prior constructions. In addition, the pallet construction of the present invention maintains and/or increases the load capacity provided by known pallet constructions.

The pallet construction is designed for use in an annular cooler and forms a gas permeable surface for supporting and transporting material during processing thereof. The pallet construction includes a pallet deck having a series of substantially parallel rows of spaced apart elongated slots. Each of the rows are offset from adjacent rows of slots in the series. The slots define apertures through the pallet construction through which, for example, cooling gas such as air may pass during processing.

A support frame supports the pallet deck and has at least one angular brace angularly oriented to the series of rows of slots. In a particular embodiment, the support frame consists of a series of angular brace members angularly oriented to the rows of slots, and a plurality of horizontal brace members extending substantially transverse to the rows of slots. The angular brace members thus intersect with the horizontal brace members to form a rigid support frame which properly supports the pallet deck while maximizing the amount of open slot area to increase the volume of cooling air that passes through the pallet.

The improved design of the pallet construction thus properly supports small sized material, such as iron pellets, while providing the same or greater structural strength as existing pallet designs. In the embodiment shown and described below, the pallet construction is designed to fit into and operate properly with existing annular cooler installations.

BRIEF DESCRIPTION OF THE DRAWINGS

Preferred embodiments of the invention are described herein below with reference to the attached figures, wherein.

DETAILED DESCRIPTION OF THE PREFERRED EMBODIMENT

Figure 1:
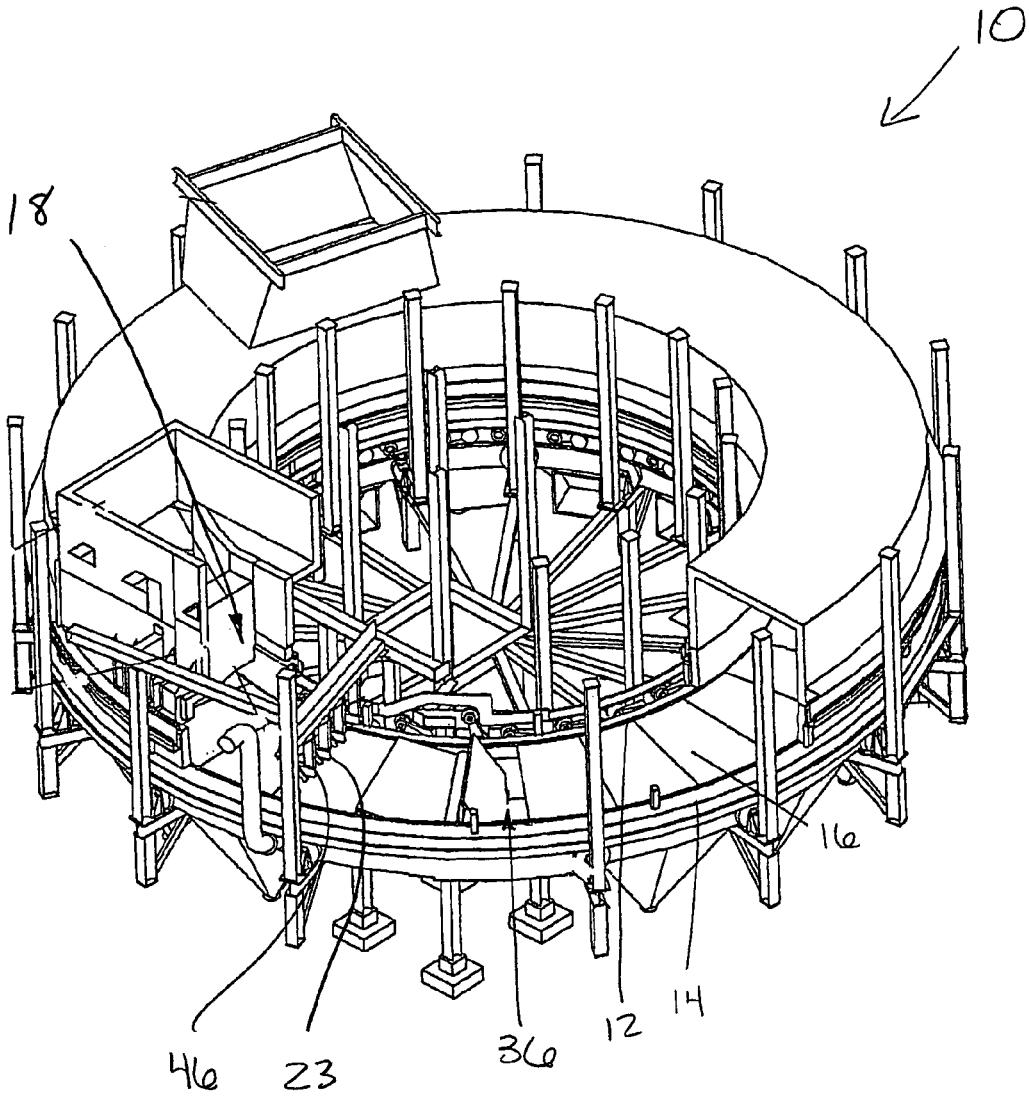
FIG. 1 depicts an annular cooler supporting and transporting a series of pallets constructed in accordance with the present invention.

In the preferred embodiment of the present invention described below, an improved pallet construction for use in an annular cooler is provided. It should be understood that the drawings and specification are to be considered an exemplification of the principles of the invention, which is more particularly defined in the appended claims. Referring to FIG. 1, an annular cooler 10 is shown. The annular cooler 10 includes inner and outer annular rail members 12, 14 respectively which support a plurality of pallet constructions 16.

When used in the production of iron ore pellets used as raw material to produce steel, the annular cooler 10 supports, transports and cools balls of iron ore that have been mixed with various elements and heated to a high temperature in a rotary kiln (not shown). The heated pellets discharge from the rotary kiln and enter the annular cooler 10 at the inlet area 18. The pellets fall onto the slotted pallet constructions 16 which travel along the inner and outer rail members 12, 14 in a clockwise direction through the annular cooler 10. During travel of the pallet constructions 16, cooling air is forced up through the pallets 16 to cool the iron ore pellets. The operation and structure of annular cooler 10 is well known in the art and therefore need not be described in detail herein.

Figure 2:
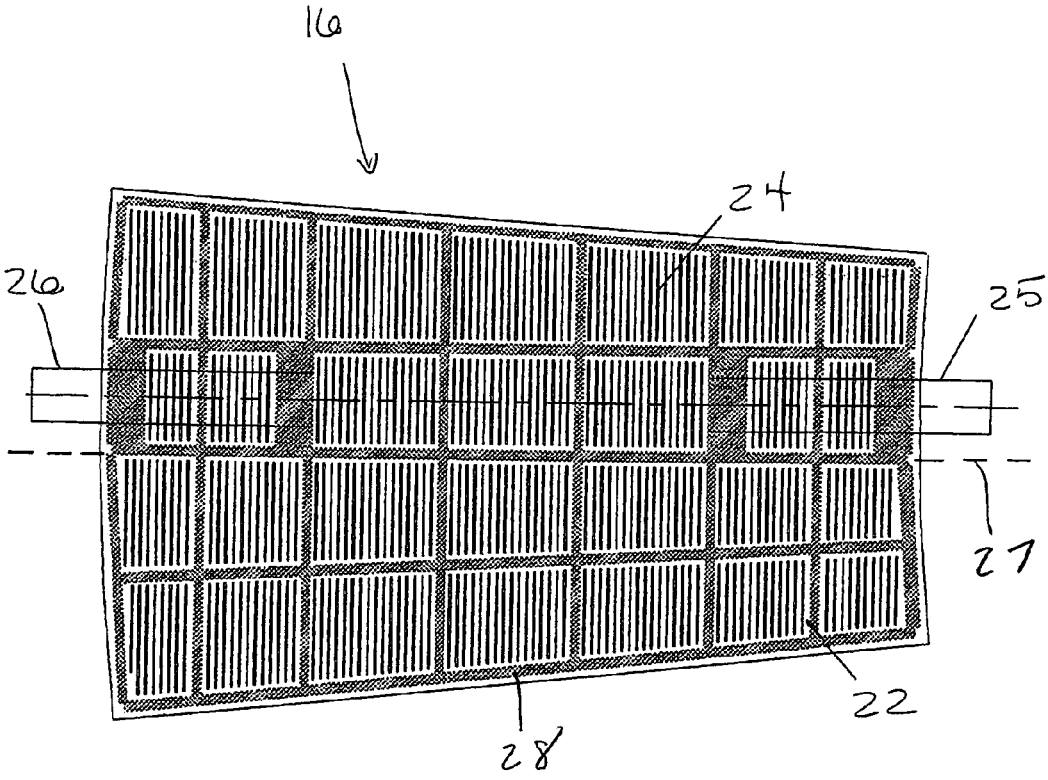
Figure 2 (Prior Art)
FIG. 2 is a bottom plan view of a prior art pallet deck.

Referring to FIG. 2 a prior art pallet construction 16 is shown. The prior art pallet 16 includes a pallet deck 22 and a support frame 28 for deck 22. Deck 22 has formed therein a series of elongated slots 24 which define apertures through the pallet deck 22. A series of elongated slots 24 thus allow cooling air which is forced through the bottom of the pallet 16 to pass through the pallet 16 and cool the iron ore pellets being carried thereon. The elongated slots 24 are generally uniform in length and orientation.

The pallet 16 is supported between the inner and outer rail members 12, 14 as its travels about the annular cooler 10 by inner and outer pallet shafts 25, 26. The opposing pallet shafts 25, 26 are slightly offset from a longitudinal center (indicated by dashed line 27 in FIG. 2) of the pallet deck 22. Each pallet deck 22 in the series of pallets 16 forms a generally truncated circular segment. In this manner, each pallet 16 in the series forms approximately a 10° segment of the annular circle formed by the inner and outer rail members 12, 14.

Figure 3:
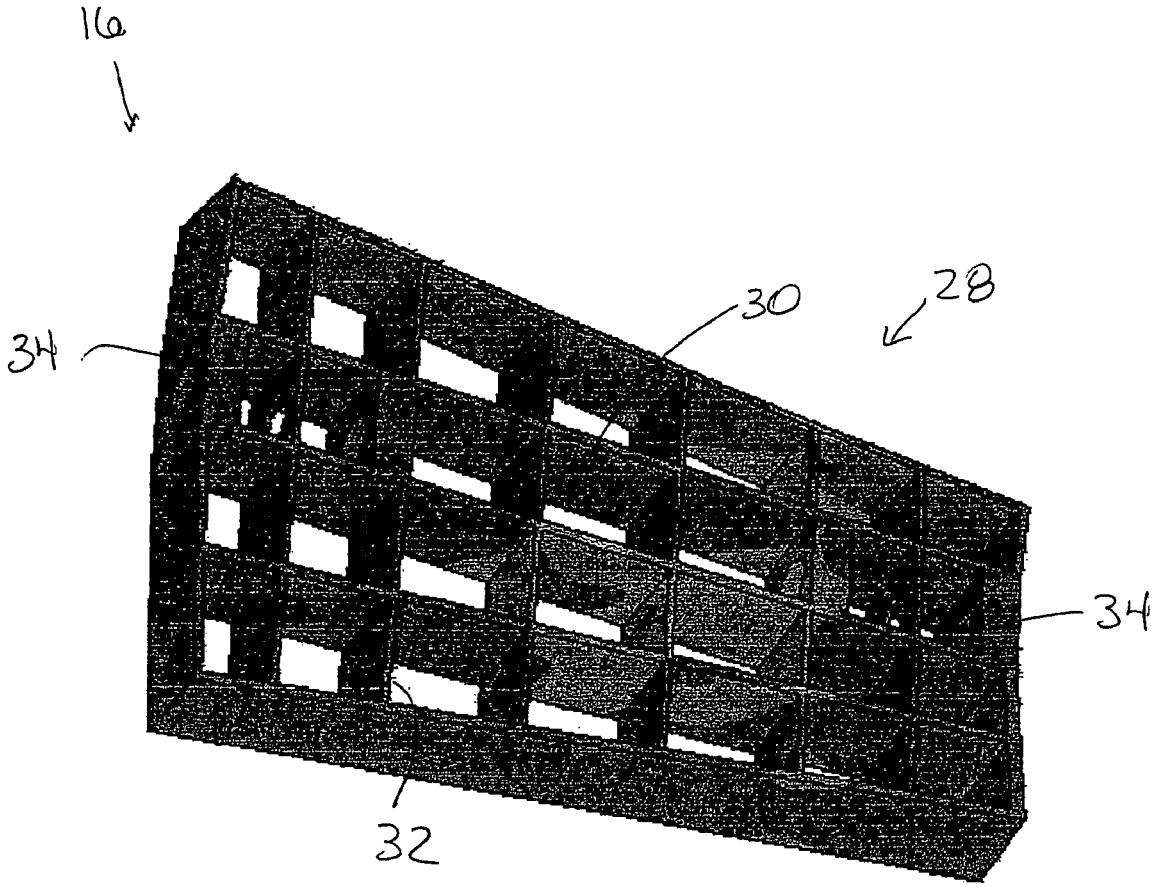
Figure 3 (Prior Art)
FIG. 3 is a perspective view of a prior art pallet frame.

Referring to FIG. 3, the support frame 28 for the prior art pallet construction 16 is shown. The support frame 28 includes a series of longitudinal 30 and lateral 32 brace members which intersect and are generally perpendicular to each other to form a plurality of adjacent individual box-like configurations. The support frame 28 is typically welded to the pallet deck 22 and receives and redistributes the loading force of the iron ore pellets on the pallet 16. In addition, the pallet frame 28 has a series of opposing bushings 34 which fixedly support the inner and outer pallet shafts 25, 26 shown in FIG. 2. The pallet frame 28 generally forms the same shape as the pallet deck 22, namely a generally truncated circular segment comprising approximately a 10° segment of the annular cooler 10 as defined by the inner and outer rail members 12, 14. It is recognized, and well known in the art, that the longitudinal and lateral brace members 30, 32 limit the slot open area and impede the travel of cooling air flow through the pallet 16, thus negatively effecting the efficiency of the annular cooler 10. More specifically, the box-like construction of frame 28 limits the number and location of slots 24 to the approximately rectangular area located between adjacent longitudinal 30 and lateral 32 brace members, as shown best in FIG. 2.

Figure 4:
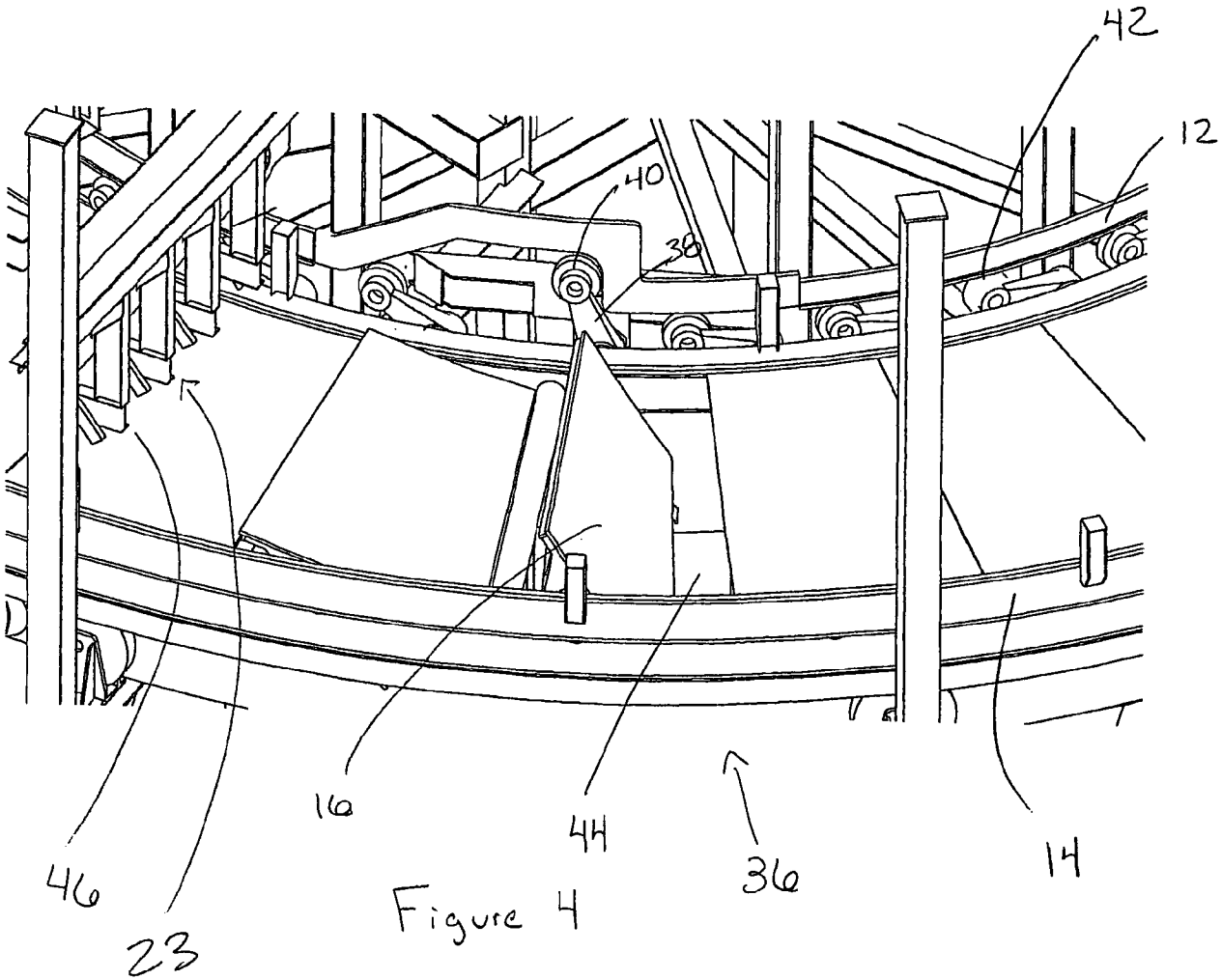
FIG. 4 is a detailed view of the dump zone in the annular cooler of FIG. 1.

Referring to FIGS. 1 and 4, once the pallet 16 has completed at least one revolution about the annular cooler 10, the pallet 16 enters a dump zone 36 for dumping the iron ore pellets for further processing. As is shown in FIG. 4, the inner shaft 25 is fixedly attached to a cam arm 38 and associated cam roller 40 which rides within a channel 42 formed in the inner rail member 12 of the annular cooler 10. The relative fixed nature of the cam arm 38 to the inner pallet shaft 26 and the pallet frame 28, prevents the pallet 16 from tipping during travel about the annular cooler 10. More specifically, the impact and weight of the iron ore pellets on the pallet 16 would normally force the pallet 16 to tip. However, tipping is prevented by the cam arm 38 and roller 40 which reside in the channel 42.

As shown in FIG. 4, in the dump zone 36, the channel 42 shifts upward, abruptly raising the path of the cam arm 38 and cam roller 40. This allows the weight of the pellets and pallet 16 to rotate the pallet 16 about the offset pallet shafts 25, 26. In this manner, the cooled pellets are dumped into a discharge chute 44, and off of the pallet 16 and out of the annular cooler 10. As the pallet 16 continues to rotate about the annular cooler 10, the channel 42 path is again lowered and the cam arm 38 and cam roller 40 follow the path of the channel 42 and force the pallet 16 to rotate back into a horizontal position and into the inlet area 18, where it again receives hot pellets from the kiln.

The pallet 16 must be designed to cooperate with the inner and outer rail members 12, 14. The pallet 16 must also have a depth small enough to fit within a clearance 23 beneath a screed wall 46 in the inlet area 18. The primary purpose of the pallet 16 is to safely support the loading of the iron ore pellets and to maximize the passage of cooling air for cooling the pellets. Under normal operating conditions, the loads applied to the pallet deck 22 include the weight of the pellet bed and the impact loading of the pellets as they fall from the kiln discharge onto the pallet 16 in the inlet area 18. An individual pellet is about ⅜ inches in diameter, so the impact loading of an individual pellet is quite small. Under normal operating conditions where the discharge of pellets from the kiln is free flowing, the pallet deck 22 does not see a significant impact loading condition. The total number of pellets on a pallet at a bed depth of 33 inches weighs approximately 14 tons therefore the pallet 16 must have sufficient structural integrity to support this loading. However, under upset conditions, large chunks of agglomerated pellets can form in the kiln. This condition will result in large impact loading on the pallet deck 22 as thousands of pellets agglomerated together fall onto the pallet 16 in one large mass.

An additional purpose of the pallet 16 is to safely pass within small clearances formed in the annular cooler 10, such as clearance 23 formed between the screed wall 46 and a flat plate (not shown) beneath the screed wall 46. The pallet construction 16 serves the necessary function of forming an air seal at various points along the annular cooler 10, as described above. Any improved pallet design should preferably maintain this air seal forming function.

Figure 5:
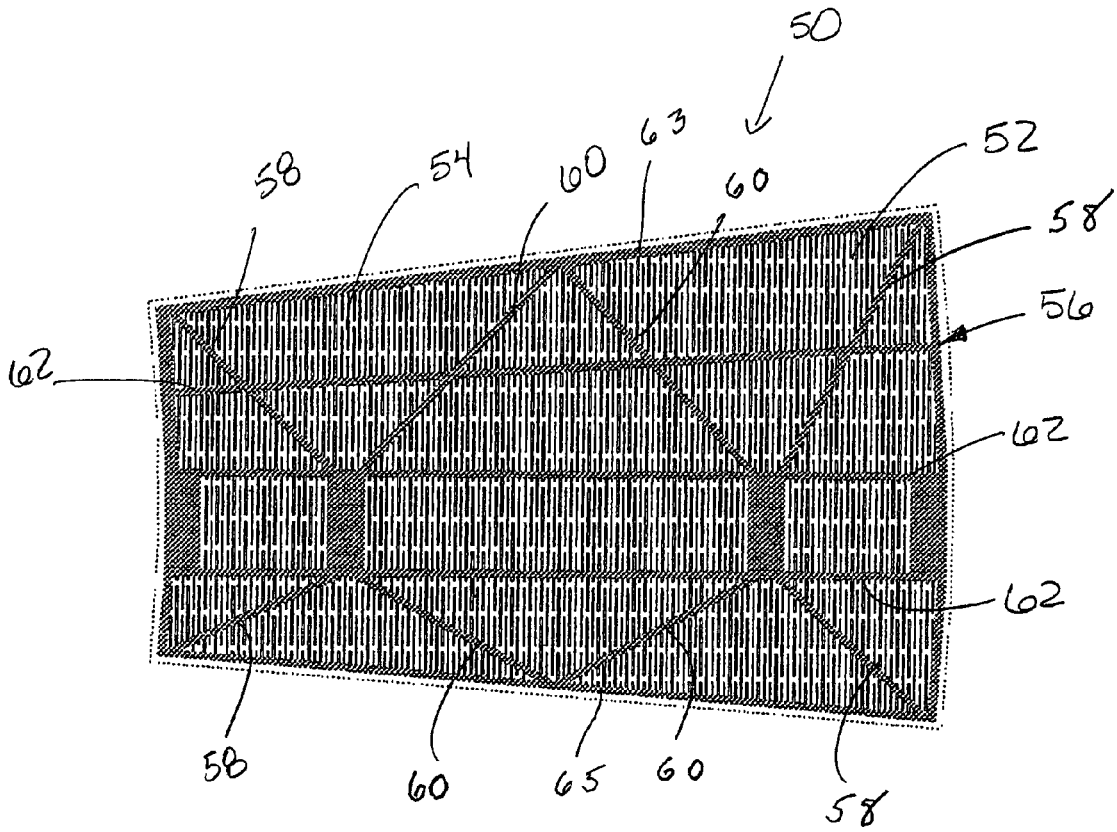
FIG. 5 is a bottom plan view of the support frame and pallet deck of the pallet construction of the present invention.

Referring now to FIG. 5, the improved pallet construction 50 of the present invention is shown. The pallet 50 includes a pallet deck 52 which has a series of substantially parallel rows of spaced apart elongated slots 54. Each of the rows of slots 54 are offset from adjacent rows of slots in the series. The slots 54 define apertures through the pallet deck 52. The pallet 50 also includes a support frame 56 supporting the pallet deck 52 and having a series of angular braces 58, 60 oriented at an acute angle to the series of rows of slots 54. In the embodiment shown, the pallet deck 52 is bevel welded to the support frame 56. However, it is recognized that any other known means for providing a fixed connection between the pallet deck 52 and support frame 56 may be employed.

Figure 6:
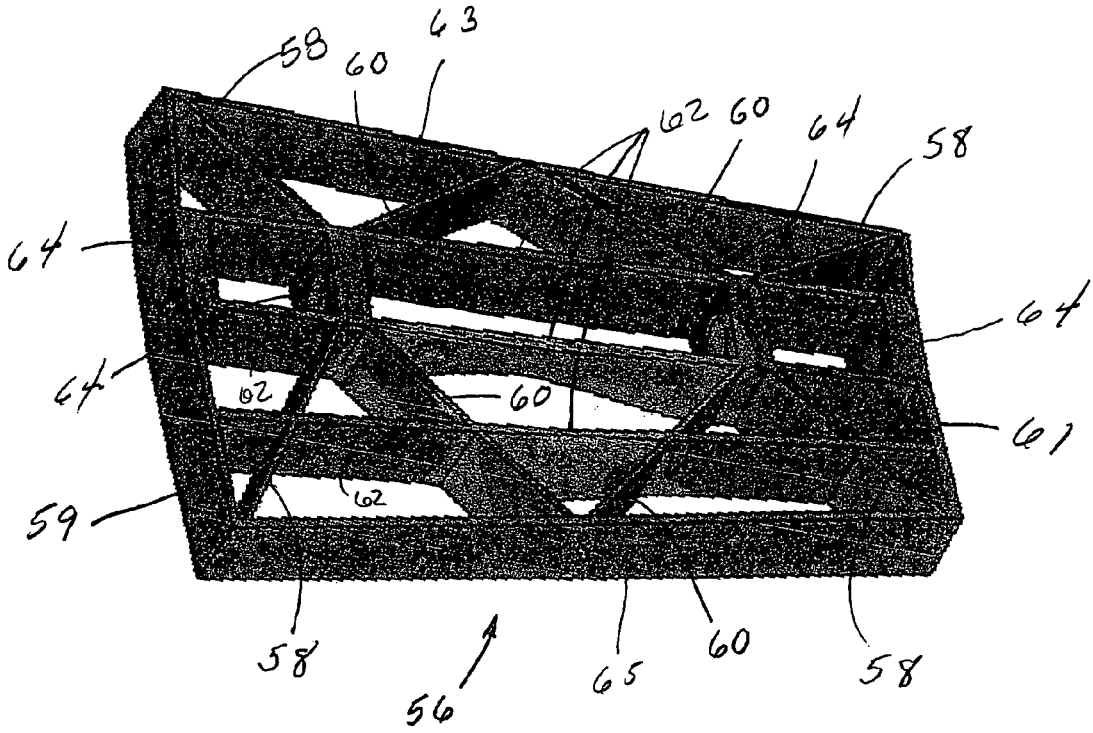
FIG. 6 is a perspective view of the pallet frame for the pallet construction of the present invention.

Referring to FIG. 6, the support frame 56 includes a framework comprised of an arcuate-shaped outer frame member 59, an arcuate-shaped inner frame member 61 concentric with outer frame member 59, a leading frame member 63, a trailing frame member 65, a plurality of spaced apart horizontal braces 62 disposed parallel to and between frame members 63 and 65, and angular braces 58, 60, which interconnect the frame members 59, 61, 63 and 65 with the horizontal brace members 62 and intersect brace members 62 at an acute angle. As shown best in FIG. 6, angular brace members 58 extend angularly inwardly from each of the inner and outer corners of support frame 56 to interconnect each corner with one or more horizontal brace member 62. Angular brace members 60 in turn extend between one or more horizontal brace member 62 and the leading frame member 63 or trailing frame member 65. As shown best in FIG. 5, brace members 60 preferably are affixed (as by bevel welding) to the midpoint between the inner and outer corners of leading frame member 63 or trailing frame member 65 to provide the desired strength for support frame 56. Each of the angular braces 58, 60 is designed in a W-like configuration to support loading applied to the pallet deck 52 which also results in covering less slot open area on the pallet deck 52 than the lateral brace member 32 of the prior art pallet construction 16, as shown in FIG. 3. The angled brace members 58, 60 maximize the amount of open slot area and maintain or improve the structural integrity, strength and dimensional features, such as depth, of the support frame 56.

The support frame 56 also includes a series of bushings 64 for supporting opposing pallet shafts (not shown in FIGS. 5–7 but identical to shafts 25 and 26 shown in FIG. 2) to connect the pallets 50 to the inner and outer rail members 12, 14, similar to the prior art pallet construction shown in FIG. 2. Because the pallet 50 incorporates the offset shaft design shown in the prior art, the pallet 50 is subjected to significant torsional loading from the iron ore pellets. In addition, most impact loading from agglomerated chucks will be offset from the shafts, which also causes torsional loading. The angular brackets 58, 60 are designed to maintain or even improve the torsional strength of the support frame to accommodate such torsional loading.

The support frame 56 forms a generally truncated circular segment such that it fits within and cooperates with the annular cooler 10 and specifically the inner and outer rail members 12, 14 described above. The structure and orientation of the angular braces 58, 60 allow the support frame 56 to maintain substantially the same depth as the prior art pallet 16, and yet cover less open slot area. The pallet 50 thus is able to increase efficiency of the cooler. The pallet 50 also maintains the necessary structural aspects of the prior art pallet 16, such that it is able to pass beneath the screed wall 46, through clearance 23, and form the necessary air seal in the cooler 10. The depth of the pallet 50 is such that the pallet 50 is able to pass through the various clearances throughout the annular cooler 10.

Figure 7:
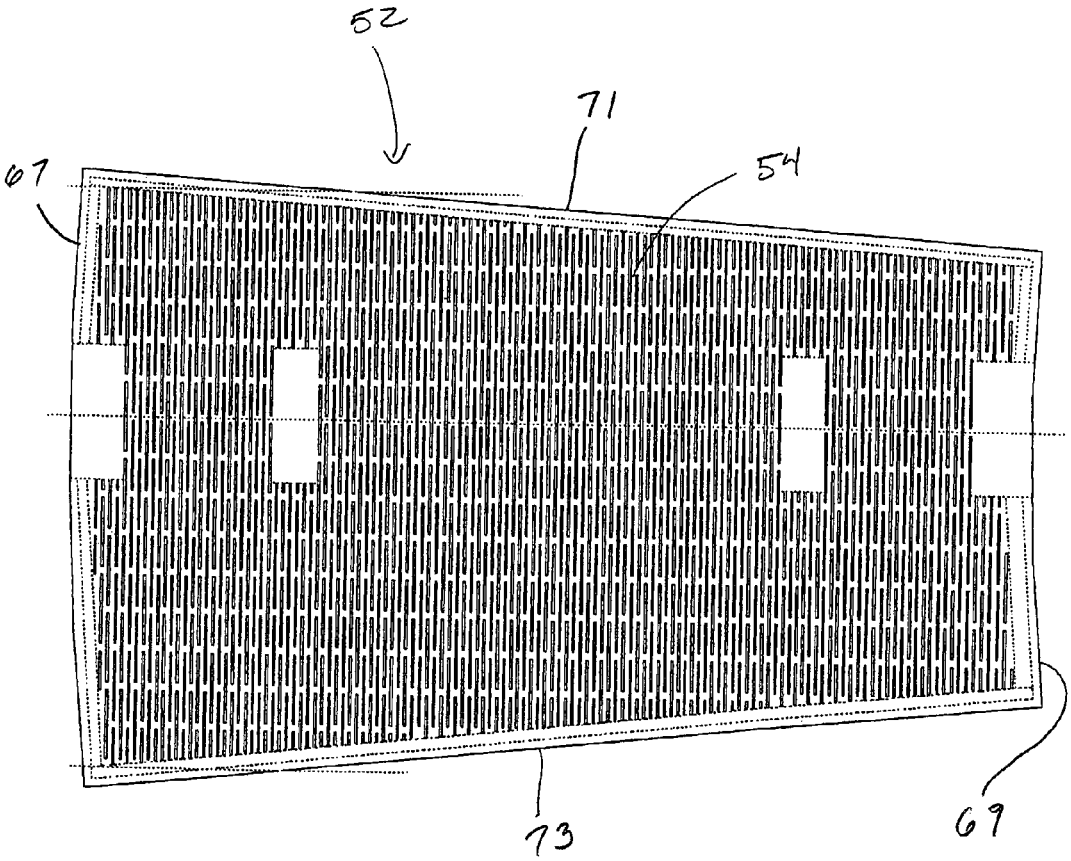
FIG. 7 is a plan view of the pallet deck of the pallet construction of the present invention.

Referring to FIG. 7, the pallet deck 52 is formed in a substantially similar shape as the support frame 56 shown in FIG. 6, namely a flat truncated circular segment. The pallet deck 52 comprises a relatively flat plate member having an arcuate-shaped outer edge 67, an arcuate-shaped inner edge 69 concentric with outer edge 67, a leading edge 71 and a trailing edge 73. Deck 52 incorporates the series of rows of staggered elongated slots 54, which maximizes the slot open area to maximize the amount of cooling air passing through the pallet 50. Preferably, the area defined by slots 54 comprises from about 25% to about 40% of the total surface area of deck 52, but more preferably 30% to 35%. Most preferably, the slots 54 comprise about 31% of the total surface area of deck 52. This represents a minimum increase in slot area of 115% over the existing pallet design shown in FIG. 2. The unique pattern of staggered elongated slots 54 also increases the strength of the pallet deck 52, as explained further with reference to FIG. 9 below.

Figure 8:
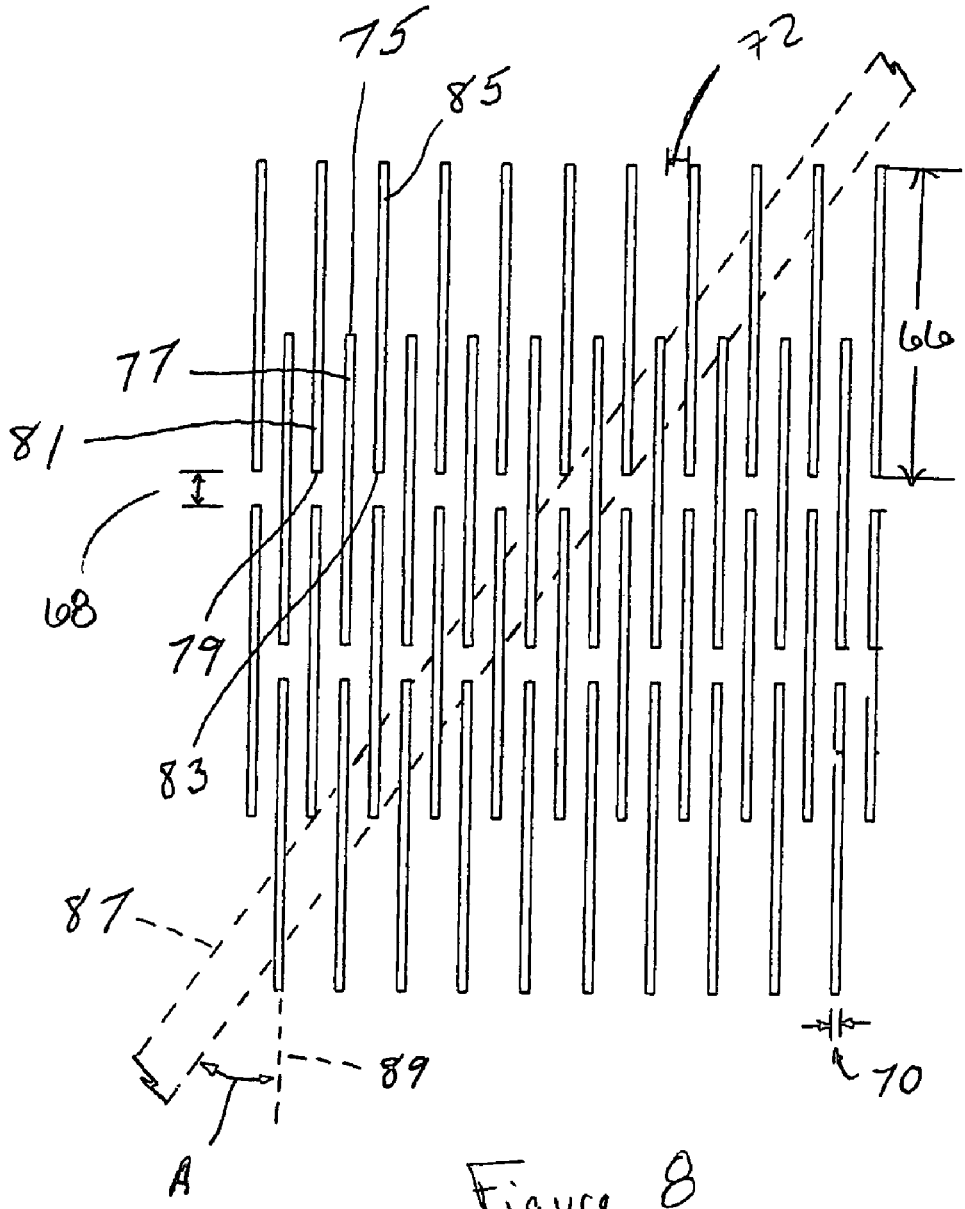
FIG. 8 is a schematic view of the staggered slot arrangement for the pallet deck of the pallet construction of the present invention.

Referring to FIG. 8, the dimensions of the elongated slots 54 are shown. Preferably, the slots 54 have a longitudinal length 66 of about 9 inches. The slots 54 are preferably spaced apart by a distance 68 of about 1 inch. Each slot 54 has a width 70 of about ¼ inch. In addition, the slots 54 are spaced apart by a lateral distance 72 of about ⅞ inch.

As used herein, the term "staggered" means that the leading edge of a slot in one row overlaps the trailing edge of a slot in an adjacent row. For example, in FIG. 8, leading edge 75 of slot 77 overlaps trailing edge 79 of adjacent slot 81 as well as trailing edge 83 of adjacent slot 85.

FIG. 8 also illustrates the acute angle A between the rows of slots and the brace members 58 or 60. As shown, brace members 58 or 60 are schematically represented in phantom lines as numeral 87 and the row of slots has a centerline represented by numeral 89. The angle A formed between 87 and 89 is an acute angle of between 1° and 89°, but is preferably between about 40° to about 60°.

Figure 9B:
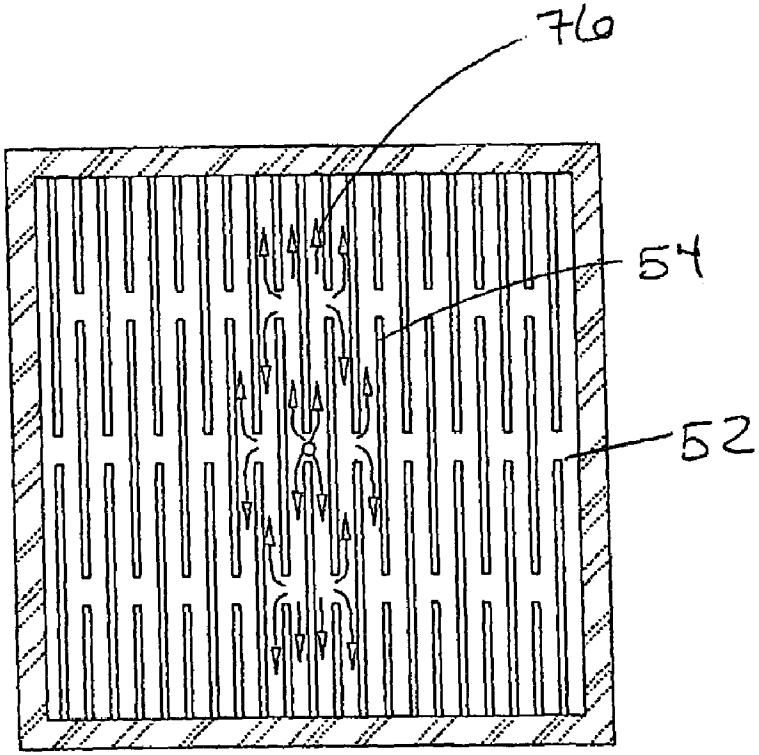
FIGS. 9A and 9B illustrate a comparison of the distribution of load for the prior art pallet deck (FIG. 9A) and the pallet deck of the present invention (FIG. 9B).
Figure 9A:
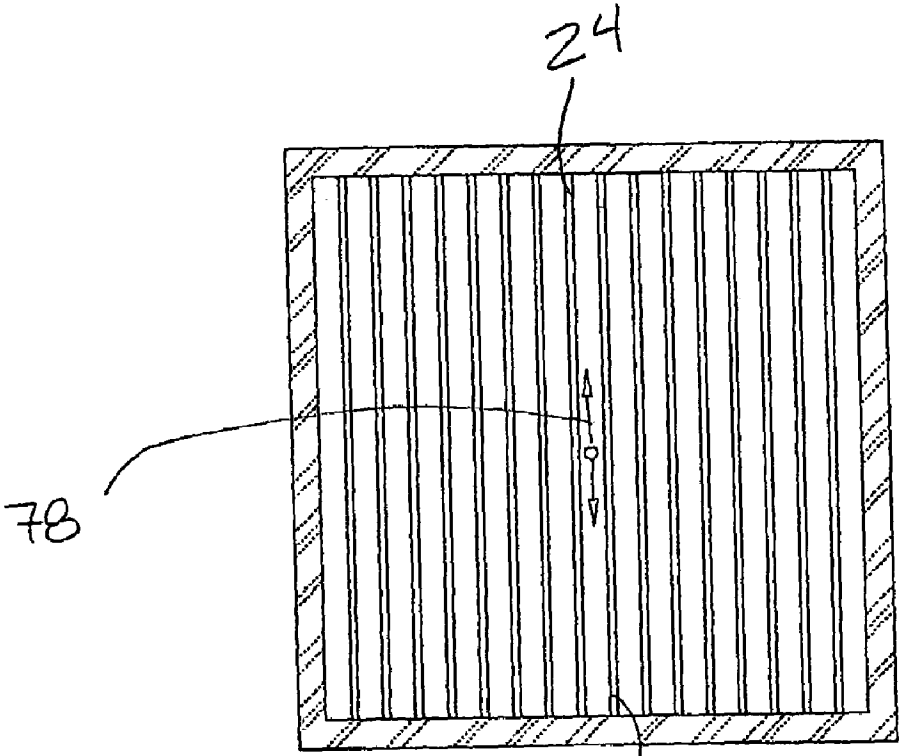
Figure 9A (Prior Art)

Referring to FIGS. 9A and 9B, the point loading for the prior art pallet 16 (FIG. 9A) and the pallet 50 (FIG. 9B) of the present invention are shown. The offset elongated slots 54 increase the capability of the pallet deck 52 to withstand impact loading. More specifically, the loading is spread over more pallet deck area by the horizontal sections 72 that are formed by the offset slots 54. This type of loading pattern is shown by arrows 76 in FIG. 9B.

In contrast, if a point loading occurs between the two elongated slots 24 of the prior art pallet 16, then the two slots 24 would take the entire point load. This results in less structural strength than the improved pallet 50. This type of loading pattern is shown by arrows 78 in FIG. 9. The improved pallet 50 distributes the load over a broader area of the pallet deck 52, which allows for increased slot area and greater air flow through the pallet 50.

It will thus be recognized that the improved pallet construction 50 provides an increased slot open area while retaining the operational and dimensional features of existing pallet designs. The improved pallet construction 50 increases the volume of cooling air that passes through the pallet 50 and maintains or increases the amount of load capacity provided by known pallet constructions. The improved pallet construction 50 properly supports small sized material, such as the above mentioned iron pellets. As such, the improved pallet design increases the efficiency of existing annular cooling systems and represents a significant advancement over the pallet constructions of the prior art.

While this invention is susceptible to embodiments in many different forms, the drawings and specification described in detail a preferred embodiment of the invention. They are not intended to limit the broad aspects of the invention to the embodiment illustrated.

I claim:

1. A pallet construction for an annular cooler forming a gas permeable surface for supporting and transporting material during processing thereof, the pallet construction comprising:

a pallet deck having a series of substantially parallel rows of spaced apart elongated slots, each of the slots in a row being staggered with respect to the slots in an adjacent row in the series, wherein the slots define apertures through the pallet deck, said pallet deck having a top surface and a bottom surface; and a support frame supporting the pallet deck, the support frame includes a framework comprised of an arcuate-shaped outer frame member, an arcuate-shaped inner frame member concentric with outer frame member, a leading frame member extending between the outer frame member and the inner frame member, a trailing frame member extending between the outer frame member and the inner frame member, a plurality of spaced apart horizontal brace members disposed between the leading and trailing frame members and extending between the outer frame member and the inner frame member, and a plurality of angular cross braces which interconnect the inner, outer, leading and trailing frame members with the horizontal brace members and intersect said horizontal brace members at an acute angle, said horizontal brace members and said angular cross braces affixed to and engaging said bottom surface of said pallet deck;

an outer bushing extending between a pair of said horizontal brace members, and disposed adjacent to and inwardly of said outer frame member;

an inner bushing extending between said pair of horizontal brace members and disposed adjacent to and outwardly of said inner frame member;

said inner and outer bushings defining an axis of rotation that is offset from a centerline of the pallet construction defined by the midpoints of said inner and outer frame members whereby said pallet deck and support frame may be tilted to discharge a load;

one of said cross braces being in a W-like configuration and extending from a corner formed by the outer and leading frame members to one of said pair of horizontal brace members at the location of said outer bushing and then to the midpoint of said leading frame member and then to said one of said pair of horizontal brace members at the location of said inner bushing and then to a corner formed by the inner and leading frame members; and another of said cross braces being in a W-like configuration and extending from a corner formed by the outer and trailing frame members to the other of said pair of horizontal brace members at the location of said outer bushing and then to the midpoint of said trailing frame member and then to said other of said pair of horizontal brace members at the location of said inner bushing and then to a corner formed by the inner and trailing frame members.

2. The pallet construction of claim 1, wherein the elongated slots in each of the rows in the series are longitudinally aligned.

3. The pallet construction of claim 1, wherein the support frame comprises at least one horizontal brace member extending substantially transverse to the rows of slots.

4. The pallet construction of claim 1, wherein each of the plurality of horizontal brace members extends substantially transverse to the rows of slots and each of the plurality of angular brace members intersects with at least one of the horizontal brace members.

5. The pallet construction of claim 1, wherein the pallet deck comprises a relatively flat plate member having an arcuate-shaped outer edge, an arcuate-shaped inner-edge concentric with said outer edge, a leading edge and a trailing edge configured so that said deck forms a truncated circular segment.

6. The pallet construction of claim 1, further comprising:

at least one shaft extending from the support frame, the shaft for coupling the pallet construction to a conveyor frame.

7. The pallet construction of claim 6, wherein the support frame further comprises a series of aligned bearings for supporting at least one shaft.

8. The pallet construction of claim 1, further comprising:

two shafts extending respectively through said outer and inner bushings in opposite directions from the support frame, the shafts for coupling the pallet construction to a conveyor frame.

9. The pallet construction of claim 1, further comprising: means for movably supporting the support frame in a conveyor system.

10. The pallet construction of claim 1, wherein the support frame is attached to the pallet deck by bevel welding.

11. A pallet construction for an annular cooler forming a gas permeable surface for supporting and transporting material during processing thereof, the pallet construction comprising:

a pallet deck having a series of substantially parallel rows of spaced apart longitudinally aligned elongated slots, each of the slots in a row being staggered with respect to the slots in an adjacent row in the series, wherein the slots define apertures through the pallet deck, said pallet deck having a top surface and a bottom surface;

a support frame supporting the pallet deck, the support frame includes a framework comprised of an arcuate-shaped outer frame member, an arcuate-shaped inner frame member concentric with outer frame member, a leading frame member extending between the outer frame member and the inner frame member, a trailing frame member extending between the outer frame member and the inner frame member, a plurality of spaced apart horizontal brace members disposed between the leading and trailing frame members and extending between the outer frame member and the inner frame member, and a plurality of angular cross braces which interconnect the inner, outer, leading and trailing frame members with the horizontal brace members and intersect said horizontal brace members at an acute angle, said horizontal brace members and said angular cross braces affixed to and engaging said bottom surface of said pallet deck;

an outer bushing extending between a pair of said horizontal brace members, and disposed adjacent to and inwardly of said outer frame member;

an inner bushing extending between said pair of horizontal brace members and disposed adjacent to and outwardly of said inner frame member;

said inner and outer bushings defining an axis of rotation that is offset from a centerline of the pallet construction defined by the midpoints of said inner and outer frame members whereby said pallet deck and support frame may be tilted to discharge a load;

one of said cross braces being in a W-like configuration and extending from a corner formed by the outer and leading frame members to one of said pair of horizontal brace members at the location of said outer bushing and then to the midpoint of said leading frame member and then to said one of said pair of horizontal brace members at the location of said inner bushing and then to a corner formed by the inner and leading frame members; and another of said cross braces being in a W-like configuration and extending from a corner formed by the outer and trailing frame members to the other of said pair of horizontal brace members at the location of said outer bushing and then to the midpoint of said trailing frame member and then to said other of said pair of horizontal brace members at the location of said inner bushing and then to a corner formed by the inner and trailing frame members; and opposing shafts coupled to and extending respectively through said outer and inner bushings in opposite directions from the support frame, wherein the two shafts are offset from the centerline of the pallet construction.

12. The pallet construction of claim 11 wherein the pallet deck comprises a relatively flat plate member having an arcuate-shaped outer edge, an arcuate-shaped inner-edge concentric with said outer edge, a leading edge and a trailing edge configured so that said deck forms a truncated circular segment.

13. The pallet construction of claim 11 wherein the area defined by the elongated slots comprises from about 25% to about 40% of the surface area of the pallet deck.

14. An annular cooler having a conveyor system forming a gas permeable surface for supporting and transporting material during cooling thereof, the conveyor system comprising:

inner and outer rail members, and a plurality of aligned pallet constructions supported by the inner and outer rail members and movable along a circular path defined by the inner and outer rail members, wherein each of the plurality of aligned pallet constructions comprises a pallet deck having a series of substantially parallel rows of spaced apart elongated slots, each of the slots in a row being staggered with respect to the slots in an adjacent row in the series, wherein the slots define apertures through the pallet deck, said pallet deck having a top surface and a bottom surface, and a support frame supporting the pallet deck, the support frame includes a framework comprised of an arcuate-shaped outer frame member, an arcuate-shaped inner frame member concentric with outer frame member, a leading frame member extending between the outer frame member and the inner frame member, a trailing frame member extending between the outer frame member and the inner frame member, a plurality of spaced apart horizontal brace members disposed between the leading and trailing frame members and extending between the outer frame member and the inner frame member, and a plurality of angular cross braces which interconnect the inner, outer, leading and trailing frame members with the horizontal brace members and intersect said horizontal brace members at an acute angle, said horizontal brace members and said angular cross braces affixed to and engaging said bottom surface of said pallet deck;

an outer bushing extending between a pair of said horizontal brace members, and disposed adjacent to and inwardly of said outer frame member;

an inner bushing extending between said pair of horizontal brace members and disposed adjacent to and outwardly of said inner frame member;

said inner and outer bushings defining an axis of rotation that is offset from a centerline of the pallet construction defined by the midpoints of said inner and outer frame members whereby said pallet deck and support frame may be tilted to discharge a load;

one of said cross braces being in a W-like configuration and extending from a corner formed by the outer and leading frame members to one of said pair of horizontal brace members at the location of said outer bushing and then to the midpoint of said leading frame member and then to said one of said pair of horizontal brace members at the location of said inner bushing and then to a corner formed by the inner and leading frame members; and another of said cross braces being in a W-like configuration and extending from a corner formed by the outer and trailing frame members to the other of said pair of horizontal brace members at the location of said outer bushing and then to the midpoint of said trailing frame member and then to said other of said pair of horizontal brace members at the location of said inner bushing and then to a corner formed by the inner and trailing frame members.

15. The annular cooler of claim 14, wherein the elongated slots in each of the rows in the series are longitudinally aligned.

16. The annular cooler of claim 14, wherein the support frame comprises at least one horizontal brace member extending substantially transverse to the rows of slots.

17. The annular cooler of claim 14, wherein each of the plurality of horizontal brace members extends substantially transverse to the rows of slots and each of the plurality of angular brace members intersects with at least one of the horizontal brace members.

18. The annular cooler of claim 14, wherein the first and second rail members comprise inner and outer concentric annular rail members which support the support frame.

19. The annular cooler of claim 14, further comprising opposing shafts extending respectively through said outer and inner bushings from the support frame, the opposing shafts coupling the support frame to the inner and outer rail members, respectively.

* * * * *